US010918544B2

(12) United States Patent
Abdullah

(10) Patent No.: US 10,918,544 B2
(45) Date of Patent: Feb. 16, 2021

(54) WHEELCHAIR LIFT APPARATUS

(71) Applicant: Muhammad Abdullah, Fresno, TX (US)

(72) Inventor: Muhammad Abdullah, Fresno, TX (US)

( * ) Notice: Subject to any disclaimer, the term of this patent is extended or adjusted under 35 U.S.C. 154(b) by 238 days.

(21) Appl. No.: 16/156,693

(22) Filed: Oct. 10, 2018

(65) Prior Publication Data

US 2020/0113757 A1 Apr. 16, 2020

(51) Int. Cl.
*A61G 5/10* (2006.01)
*A61G 5/14* (2006.01)

(52) U.S. Cl.
CPC ..... *A61G 5/1059* (2013.01); *A61G 5/104* (2013.01); *A61G 5/14* (2013.01); *A61G 5/1013* (2013.01)

(58) Field of Classification Search
CPC ..... A61G 3/02; A61G 5/1005; A61G 5/104; A61G 5/1013; A61G 5/1059; A61G 5/125; A61G 5/128; A61G 5/14; A61G 2200/34; A61G 2200/36; A61G 7/10; A61G 7/1019; A61G 7/1059; Y10S 297/10
See application file for complete search history.

(56) References Cited

U.S. PATENT DOCUMENTS 4,613,151 A 9/1986 Kielczewski
4,862,997 A * 9/1989 Eberle ..... A61G 5/1059 182/148
5,265,689 A * 11/1993 Kauffmann ..... A61G 5/042 180/65.51
5,601,302 A 2/1997 Beard
6,142,568 A 11/2000 Abelbeck
6,783,179 B2 8/2004 Komura
6,935,648 B2 * 8/2005 Beck ..... A61G 5/1059 280/250.1
7,077,416 B2 * 7/2006 Duarte ..... A61G 5/023 280/304.1
7,090,241 B2 8/2006 Silva
7,247,128 B2 * 7/2007 Oga ..... A63B 21/00181 297/DIG. 10
7,669,863 B2 * 3/2010 Steiner ..... A61H 3/04 280/87.05
7,716,759 B2 5/2010 Wilder
8,128,120 B2 3/2012 Porcheron
8,556,347 B2 * 10/2013 Lin ..... A61G 5/125 297/334
8,973,997 B2 * 3/2015 Green ..... A61G 5/1067 297/330

(Continued)

*Primary Examiner* — Ruth Ilan
*Assistant Examiner* — Maurice L Williams

(57) ABSTRACT

A wheelchair lift apparatus for assisted wheelchair loading and unloading includes a base frame having a front end, a rear end, a left side, and a right side. A plurality of wheels is coupled to the base frame. A vertical frame is perpendicularly coupled to the rear end of the base frame. A lift track is coupled to the vertical frame. A lift car is coupled to the lift track and has a track engagement portion and a perpendicular platform. The track engagement portion is slidably engageable with the lift track. A seat is coupled to the perpendicular platform. A lift bracket is coupled to the rear end of the base frame. A lift mechanism is coupled to the lift bracket and is in operational communication with the lift car to move the lift car to and from a lowered position and an alternate raised position.

14 Claims, 7 Drawing Sheets

(56) References Cited

U.S. PATENT DOCUMENTS

| | | | | |
|---|---|---|---|---|
| 9,565,947 | B2 * | 2/2017 | Oblak | A63B 23/0405 |
| 9,566,200 | B2 | 2/2017 | Multhem | |
| 9,713,560 | B1 | 7/2017 | Raymond | |
| 9,855,175 | B2 * | 1/2018 | Wike, Jr. | A61G 5/125 |
| 10,245,198 | B2 * | 4/2019 | Lucas | A61G 7/1059 |
| 10,299,972 | B2 * | 5/2019 | Kuiken | A61G 5/026 |
| 2002/0079727 | A1 * | 6/2002 | Hoegh | A61G 5/1054 297/313 |
| 2004/0080190 | A1 * | 4/2004 | Markwald | A61G 5/1067 297/61 |
| 2004/0135357 | A1 * | 7/2004 | Chang | B60K 1/02 280/781 |
| 2005/0039256 | A1 * | 2/2005 | Price | A61G 7/1011 5/86.1 |
| 2007/0084648 | A1 | 4/2007 | DuFresne | |
| 2008/0111339 | A1 * | 5/2008 | Suddaby | A61G 5/12 280/250.1 |
| 2012/0104818 | A1 * | 5/2012 | Morris | A61G 7/1011 297/316 |
| 2012/0126601 | A1 * | 5/2012 | Smith | A61G 5/14 297/339 |
| 2016/0166451 | A1 * | 6/2016 | Tekulve | A63B 21/40 297/5 |
| 2016/0184158 | A1 * | 6/2016 | Tu | A61G 7/1051 5/87.1 |
| 2016/0302902 | A1 * | 10/2016 | Wolfsberger | A01K 13/00 |
| 2017/0066462 | A1 * | 3/2017 | Wright | A61G 7/1059 |
| 2018/0064592 | A1 * | 3/2018 | Sweeney | A61G 7/0524 |
| 2018/0200128 | A1 * | 7/2018 | Chun | A61G 5/1091 |
| 2019/0053970 | A1 * | 2/2019 | Vatti | A61G 7/1049 |
| 2019/0117483 | A1 * | 4/2019 | Tessmer | A61G 7/005 |

* cited by examiner

WHEELCHAIR LIFT APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to wheelchairs and more particularly pertains to a new wheelchair for assisted wheelchair loading and unloading.

BRIEF SUMMARY OF THE INVENTION

An embodiment of the disclosure meets the needs presented above by generally comprising a base frame having a front end, a rear end, a left side, and a right side. A plurality of wheels is coupled to the base frame. A vertical frame has a front side, a rear side, a top end, and a bottom end. The bottom end is perpendicularly coupled to the rear end of the base frame. A lift track is coupled to the front side of the vertical frame. A lift car is coupled to the lift track and has a track engagement portion and a perpendicular platform. The track engagement portion is slidably engageable with the lift track. A seat is coupled to the perpendicular platform. A lift bracket is coupled to the rear end of the base frame. A lift mechanism is coupled to the lift bracket and is in operational communication with the lift car to move the lift car to and from a lowered position and an alternate raised position. A battery bracket is coupled to the front end of the base frame. A battery is coupled to the battery bracket, and is in operational communication with, and provides power to, the lift mechanism.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
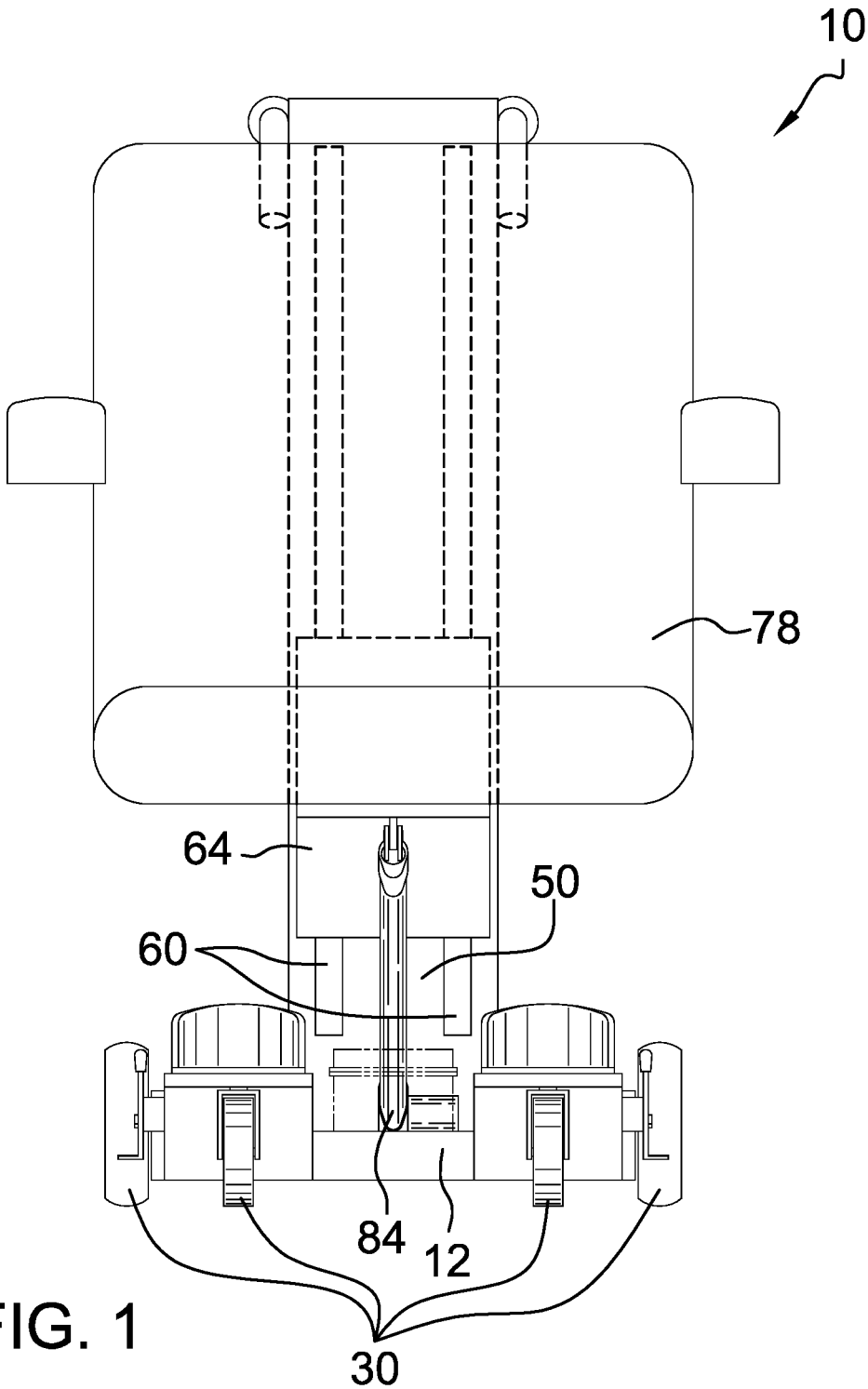
FIG. 1 is a front elevation view of a wheelchair lift apparatus according to an embodiment of the disclosure.
Figure 2:
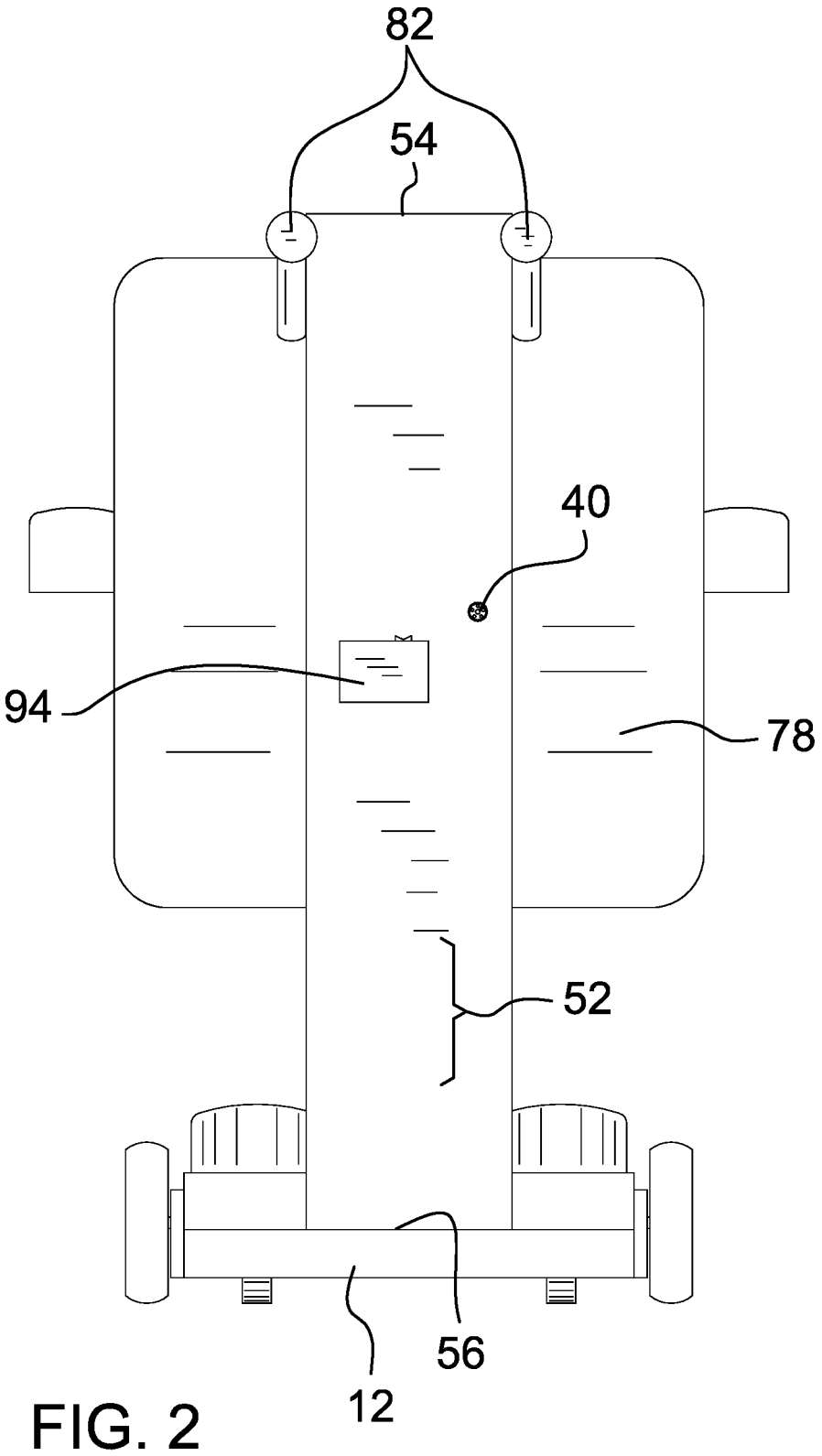
FIG. 2 is a rear elevation view of an embodiment of the disclosure.
Figure 3:
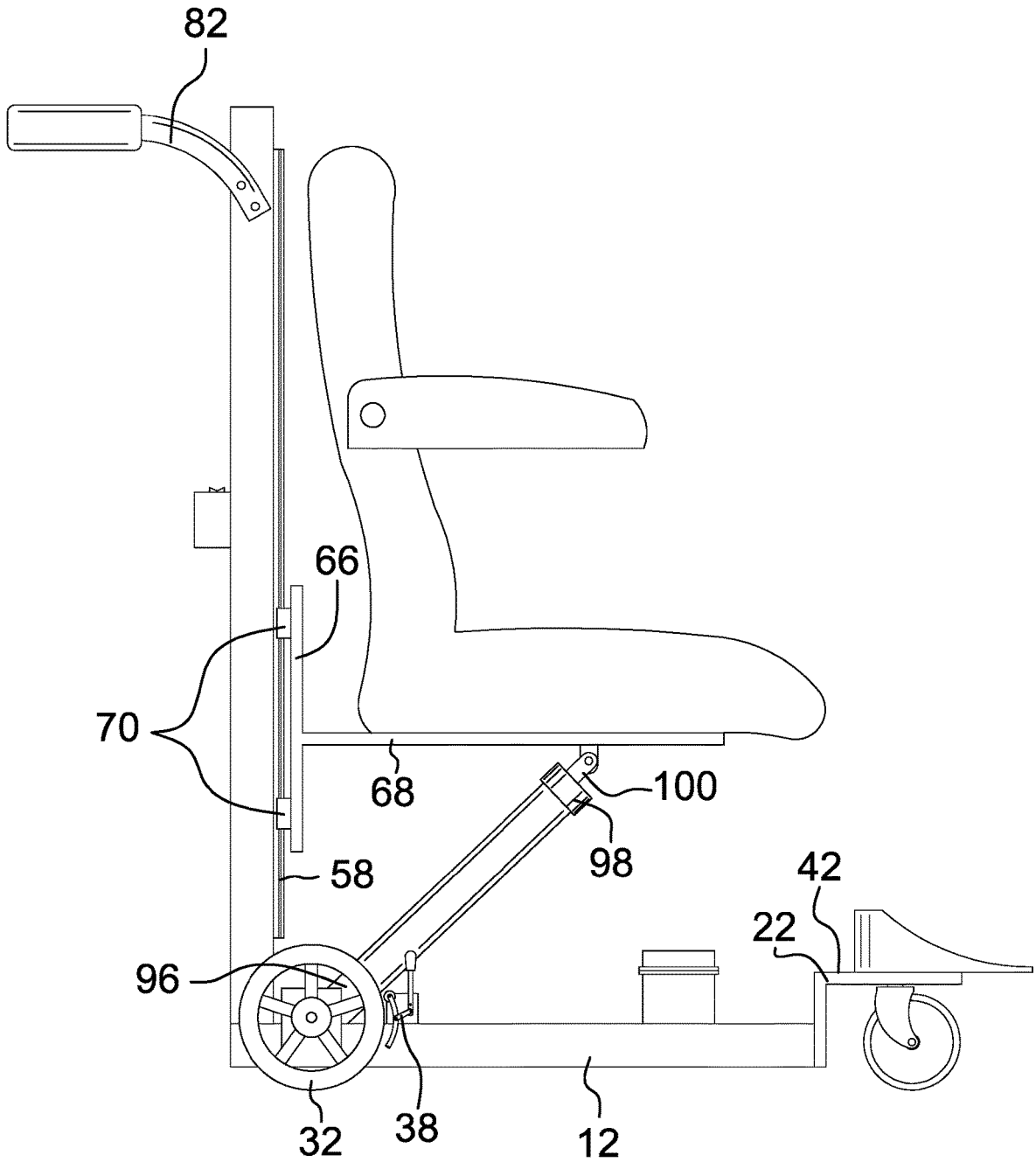
FIG. 3 is a side elevation view of an embodiment of the disclosure.
Figure 4:
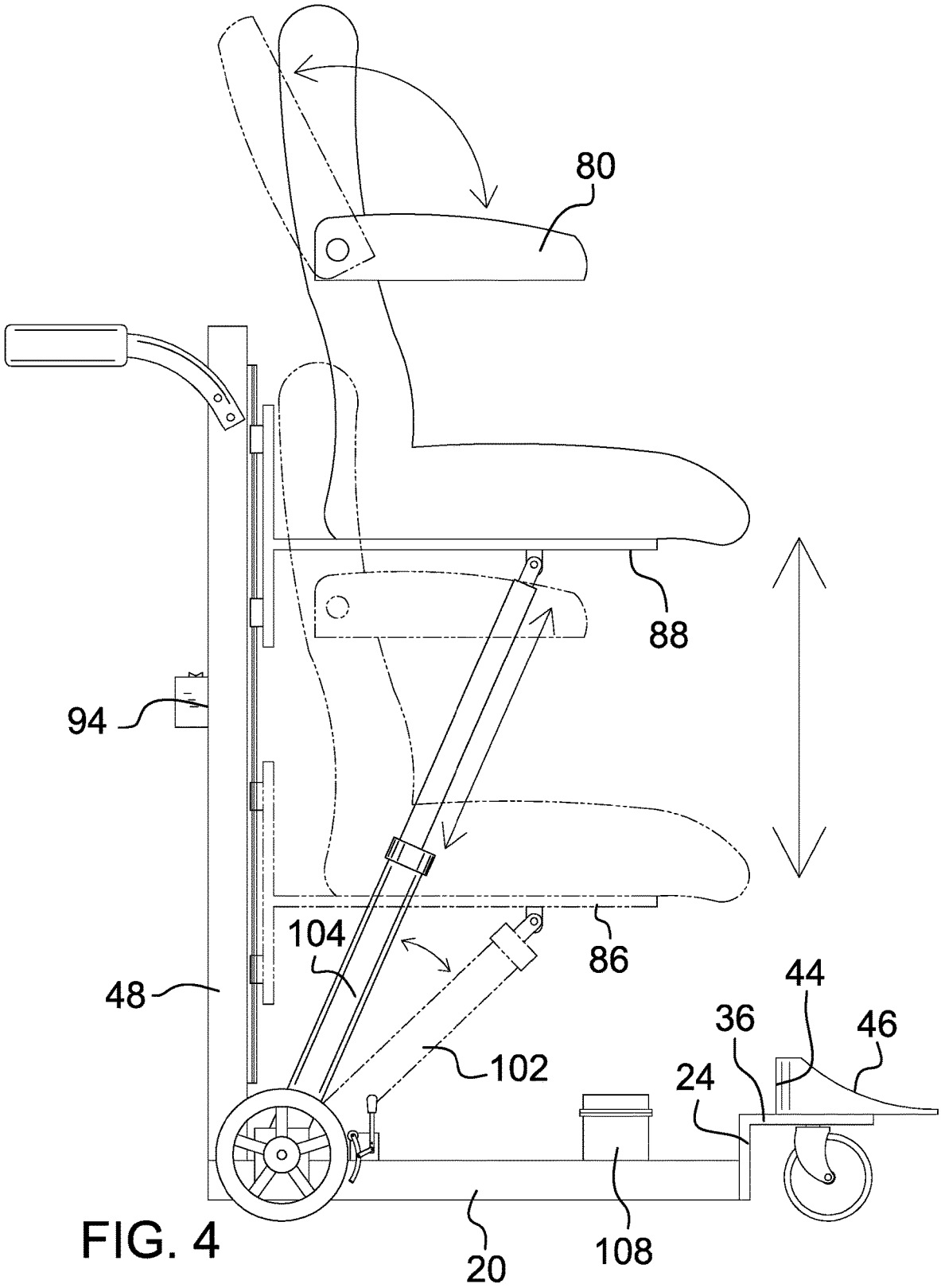
FIG. 4 is an in-use side elevation view of an embodiment of the disclosure.
Figure 5:
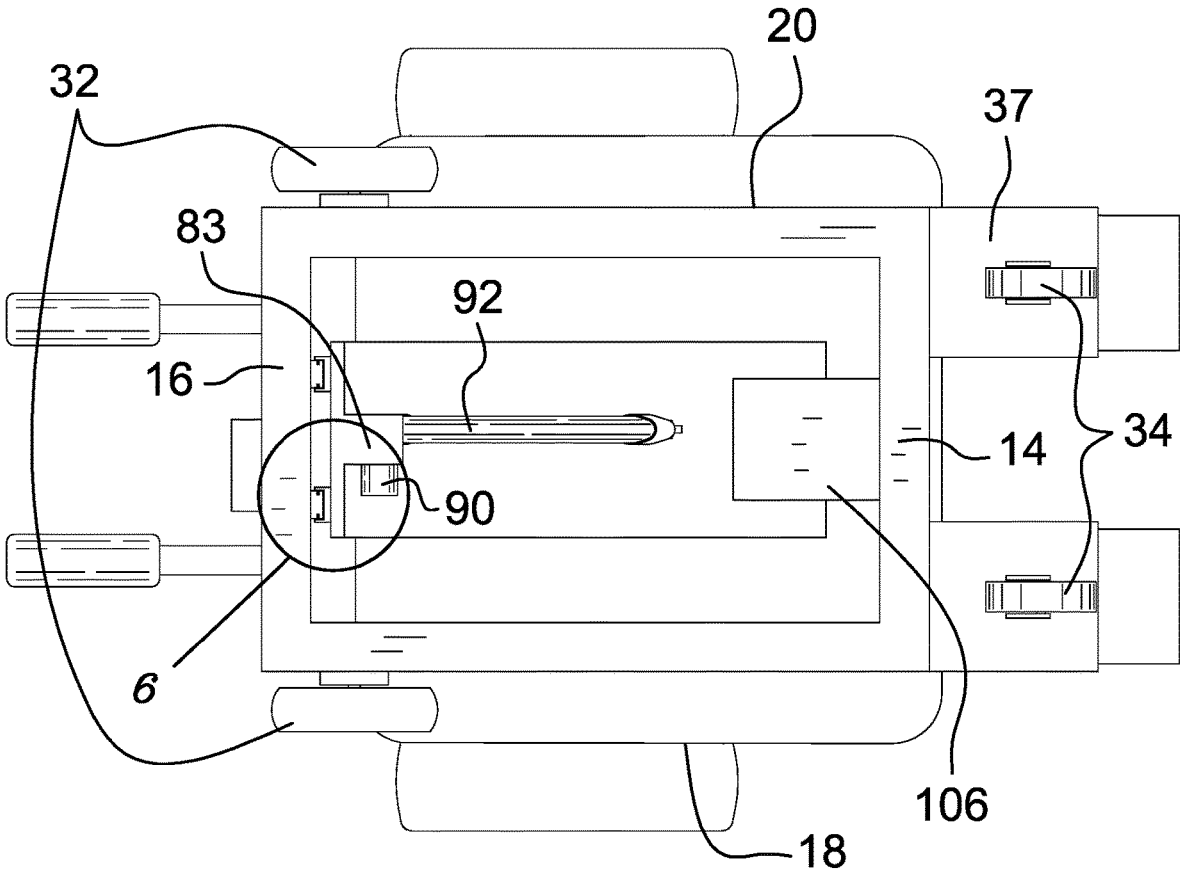
FIG. 5 is a bottom plan view of an embodiment of the disclosure.
Figure 6:
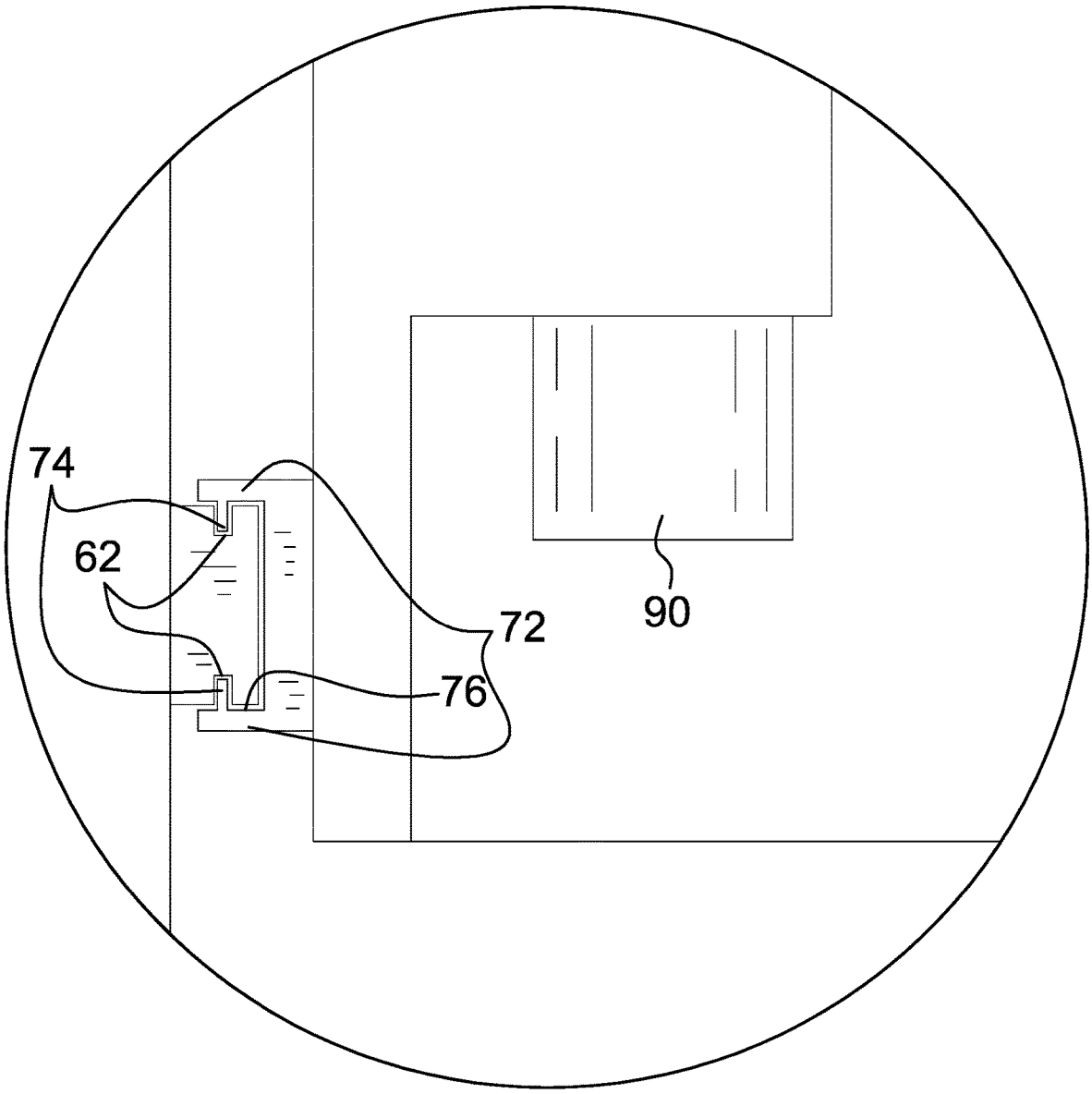
FIG. 6 is a detail view of an embodiment of the disclosure of area 6 of FIG. 5.
Figure 7:
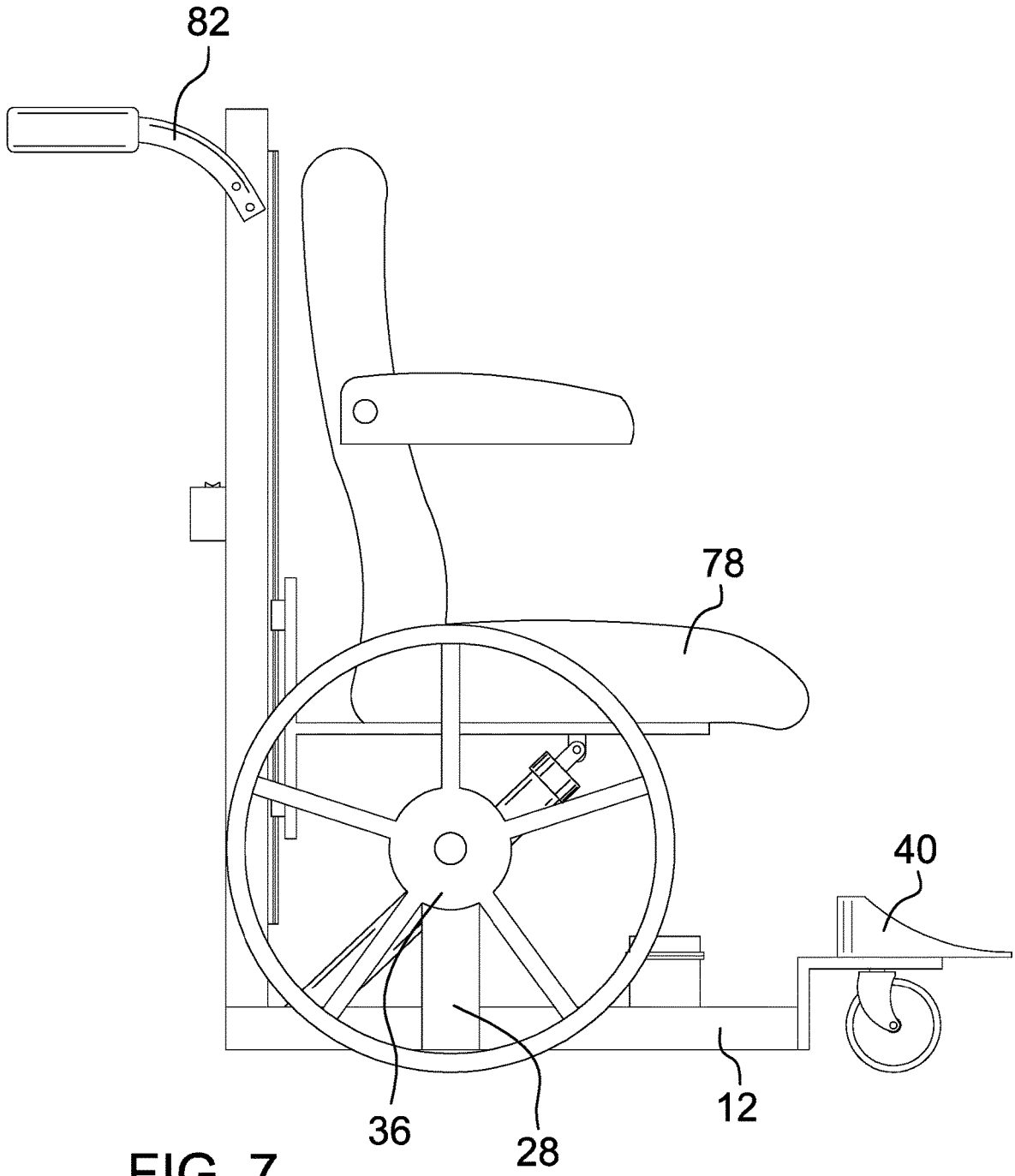
FIG. 7 is a side elevation view of an embodiment of the disclosure.

With reference now to the drawings, and in particular to FIGS. 1 through 7 thereof, a new wheelchair embodying the principles and concepts of an embodiment of the disclosure and generally designated by the reference numeral 10 will be described.

As best illustrated in FIGS. 1 through 7, the wheelchair lift apparatus 10 generally comprises a base frame 12 having a front end 14, a rear end 16, a left side 18, and a right side 20. A pair of wheel wells 22 may be coupled to the base frame 12. Each of the pair of wheel wells 22 may have a vertical riser 24 and a horizontal extension 26 with the vertical riser 24 being coupled to the front end 16 of the base frame. A pair of vertical wheel supports 28 may be coupled to the right side 20 and the left side 18 of the base frame. A plurality of wheels 30 is coupled to the base frame 12 and comprises a pair of rear wheels 32 and a pair of swivelable front wheels 34. The pair of rear wheels 32 may be a pair of push wheels 36 coupled to the pair of vertical wheel supports 28. The pair of rear wheels 32 may alternatively be coupled directly to the left side 18 and the right side 20 of the base frame proximal the rear end 16. The pair of swivelable front wheels is coupled to an underside 37 of the horizontal extension of the pair of wheel wells. The pair of wheel wells 22 and the pair of vertical wheel supports 28 allow the base frame 12 to remain lower to the ground, keeping the center of gravity of the wheelchair lift apparatus 10 as low as possible to increase stability. A pair of wheel locks 38 may be coupled to the base frame 12 and is selectively engageable with the pair of rear wheels 32 to prevent the wheelchair lift apparatus 10 from rolling.

A pair of footrests 40 may be coupled a top side 42 of the horizontal extension 26 of the pair of wheel wells. Each of the pair of footrests 40 may have a raised back 44 and a tapered profile 46 to secure the back of a user's feet. A vertical frame 48 has a front side 50, a rear side 52, a top end 54, and a bottom end 56. The bottom end 56 is perpendicularly coupled to the rear end 16 of the base frame. A lift track 58 is coupled to the front side 50 of the vertical frame and may comprise a pair of track rails 60. Each of the pair of track rails 60 may be an H-shape having a pair of slots 62. A lift car 64 has a track engagement portion 66 and a perpendicular platform 68. There may be a plurality of sliding retainer clips 70 coupled to the track engagement portion 66 of the lift car. Each of the plurality of sliding retainer clips 70 may have a pair of arms 72 and a pair of fingers 74 with each of the pair of fingers 74 being perpendicularly coupled to an inside edge 76 of each of the pair of arms. The pair of fingers 74 is slidably engageable within the pair of slots 62 of the pair of track rails to make the lift car 64 slidable along the lift track 58. A seat 78 is coupled to the perpendicular platform 68 and may have a pair of pivotable armrests 80. A pair of handles 82 may be coupled to the vertical frame 48 proximal the top end 54 and extends perpendicularly to the rear side 52.

A lift bracket 83 is coupled to the rear end 16 of the base frame. A lift mechanism 84 is coupled to the lift bracket 83 to move the lift car 64 to and from a lowered position 86 and an alternate raised position 88. The lift mechanism 84 may comprise a motor 90, an actuator arm 92, and a control switch 94. The motor 90 is coupled to the lift bracket 82. The actuator arm 92 has a proximal end 96 pivotably coupled to the motor 90 and a distal end 98 having a hinged tip 100 coupled to the perpendicular platform 68 of the lift car. The actuator arm 92 has a compacted position 102 when the lift car 64 is in the lowered position 86 and an alternate extended position 104 when the lift car 64 is in the raised position 88. The control switch 94 is coupled to the vertical frame 48 and is in operational communication with the motor 90 to move the actuator arm 92 from the compacted position 102 to the alternate extended position 104. A battery bracket 106 is coupled to the front end 14 of the base frame. A battery 108 is coupled to the battery bracket 106. The battery 108 is in operational communication with, and provides power to, the motor 90. A charging port 110 may be coupled to the vertical frame 48 and is in operational communication with the battery 108.

In use, the user may control the wheelchair lift apparatus 10 with the rear push wheels 36 if present, or an assistant may push the wheelchair lift apparatus 10 using the pair of handles 82. The control switch 94 is used to move the lift car 64 and the user from the lowered position 86 to the raised position 88 to assist in unloading and loading the user from the seat 78.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wheelchair lift apparatus comprising:

a base frame having a front end, a rear end, a left side, and a right side;

a plurality of wheels coupled to the base frame;

a vertical frame coupled to the base frame, the vertical frame having a front side, a rear side, a top end, and a bottom end, the bottom end being perpendicularly coupled to the rear end of the base frame;

a lift track coupled to the vertical frame, the lift track being coupled to the front side;

a lift car coupled to the lift track, the lift car having a track engagement portion and a perpendicular platform, the track engagement portion being slidably engageable with the lift track;

a seat coupled to the lift car, the seat being coupled to the perpendicular platform;

a lift bracket coupled to the base frame, the lift bracket being coupled to the rear end of the base frame;

a lift mechanism coupled to the lift bracket, the lift mechanism being in operational communication with the lift car, the lift mechanism moving the lift car to and from a lowered position and an alternate raised position;

a battery bracket coupled to the base frame, the battery bracket being coupled to the front end of the base frame;

a battery coupled to the battery bracket, the battery being in operational communication with, and providing power to, the lift mechanism; and the lift mechanism comprising a motor coupled to the lift bracket, the motor being in operational communication with the battery, an actuator arm coupled to the motor, the actuator arm having a proximal end pivotably coupled to the motor and a distal end having a hinged tip, the hinged tip being coupled to the perpendicular platform of the lift car, the actuator arm having a compacted position when the lift car is in the lowered position and an alternate extended position when the lift car is in the raised position, and a control switch coupled to the vertical frame, the control switch being in operational communication with the motor to move the actuator arm from the compacted position to the alternate extended position.

2. The wheelchair lift apparatus of claim 1 further comprising a pair of handles coupled to the vertical frame proximal the top end, the pair of handles extending perpendicularly to the rear side.

3. The wheelchair lift apparatus of claim 1 further comprising the lift track comprising a pair of track rails, each of the pair of track rails being an H-shape having a pair of slots.

4. The wheelchair lift apparatus of claim 1 further comprising the plurality of wheels comprising a pair of rear wheels coupled to the base frame proximal the rear end and a pair of swivelable front wheels coupled to the base frame proximal the front end.

5. The wheelchair lift apparatus of claim 4 further comprising a pair of wheel wells coupled to the base frame, each of the pair of wheel wells having a vertical riser and a horizontal extension, the vertical riser being coupled to the front end of the base frame, the pair of swivelable front wheels being coupled to an underside of the horizontal extension.

6. The wheelchair lift apparatus of claim 4 further comprising a pair of wheel locks coupled to the base frame, the pair of wheel locks being selectively engageable with the pair of rear wheels to prevent the wheelchair lift apparatus from rolling.

7. The wheelchair lift apparatus of claim 4 further comprising a pair of vertical wheel supports coupled to the right side and the left side of the base frame, the pair of rear wheels being coupled to the pair of vertical wheel supports, the pair of rear wheels being push wheels.

8. The wheelchair lift apparatus of claim 7 further comprising the seat having a pair of pivotable armrests.

9. The wheelchair lift apparatus of claim 1 further comprising a charging port coupled to the vertical frame, the charging port being in operational communication with the battery.

10. A wheelchair lift apparatus comprising:

a base frame having a front end, a rear end, a left side, and a right side;

a plurality of wheels coupled to the base frame;

a vertical frame coupled to the base frame, the vertical frame having a front side, a rear side, a top end, and a bottom end, the bottom end being perpendicularly coupled to the rear end of the base frame;

a lift track coupled to the vertical frame, the lift track being coupled to the front side, the lift track comprising a pair of track rails, each of the pair of track rails being an H-shape having a pair of slots;

a lift car coupled to the lift track, the lift car having a track engagement portion and a perpendicular platform, the track engagement portion being slidably engageable with the lift track;

a seat coupled to the lift car, the seat being coupled to the perpendicular platform;

a lift bracket coupled to the base frame, the lift bracket being coupled to the rear end of the base frame;

a lift mechanism coupled to the lift bracket, the lift mechanism being in operational communication with the lift car, the lift mechanism moving the lift car to and from a lowered position and an alternate raised position;

a battery bracket coupled to the base frame, the battery bracket being coupled to the front end of the base frame;

a battery coupled to the battery bracket, the battery being in operational communication with, and providing power to, the lift mechanism; and a plurality of sliding retainer clips, the plurality of sliding retainer clips being coupled to the track engagement portion of the lift car, each of the plurality of sliding retainer clips having a pair of arms and a pair of fingers, each of the pair of fingers being perpendicularly coupled to an inside edge of each of the pair of arms, the pair of fingers being slidably engageable within the pair of slots of the pair of track rails.

11. A wheelchair lift apparatus comprising:

a base frame having a front end, a rear end, a left side, and a right side;

a plurality of wheels coupled to the base frame, the plurality of wheels comprising a pair of rear wheels coupled to the base frame proximal the rear end and a pair of swivelable front wheels coupled to the base frame proximal the front end;

a vertical frame coupled to the base frame, the vertical frame having a front side, a rear side, a top end, and a bottom end, the bottom end being perpendicularly coupled to the rear end of the base frame;

a lift track coupled to the vertical frame, the lift track being coupled to the front side;

a lift car coupled to the lift track, the lift car having a track engagement portion and a perpendicular platform, the track engagement portion being slidably engageable with the lift track;

a seat coupled to the lift car, the seat being coupled to the perpendicular platform;

a lift bracket coupled to the base frame, the lift bracket being coupled to the rear end of the base frame;

a lift mechanism coupled to the lift bracket, the lift mechanism being in operational communication with the lift car, the lift mechanism moving the lift car to and from a lowered position and an alternate raised position;

a battery bracket coupled to the base frame, the battery bracket being coupled to the front end of the base frame;

a battery coupled to the battery bracket, the battery being in operational communication with, and providing power to, the lift mechanism;

a pair of wheel wells coupled to the base frame, each of the pair of wheel wells having a vertical riser and a horizontal extension, the vertical riser being coupled to the front end of the base frame, the pair of swivelable front wheels being coupled to an underside of the horizontal extension; and a pair of footrests coupled to the pair of wheel wells, the pair of footrests being coupled to a top side of the horizontal extension of the pair of wheel wells.

12. The wheelchair lift apparatus of claim 11 further comprising each of the pair of footrests having a raised back and a tapered profile.

13. A wheelchair lift apparatus comprising:

a base frame having a front end, a rear end, a left side, and a right side;

a pair of wheel wells coupled to the base frame, each of the pair of wheel wells having a vertical riser and a horizontal extension, the vertical riser being coupled to the front end of the base frame;

a pair of vertical wheel supports coupled to the right side and the left side of the base frame;

a plurality of wheels coupled to the base frame, the plurality of wheels comprising a pair of rear wheels being coupled to the pair of vertical wheel supports and a pair of swivelable front wheels coupled to an underside of the horizontal extension of the pair of wheel wells, the pair of rear wheels being push wheels;

a pair of wheel locks coupled to the base frame, the pair of wheel locks being selectively engageable with the pair of rear wheels to prevent the wheelchair lift apparatus from rolling;

a pair of footrests coupled to the pair of wheel wells, the pair of footrests being coupled to a top side of the horizontal extension of the pair of wheel wells, each of the pair of footrests having a raised back and a tapered profile;

a vertical frame coupled to the base frame, the vertical frame having a front side, a rear side, a top end, and a bottom end, the bottom end being perpendicularly coupled to the rear end of the base frame;

a lift track coupled to the vertical frame, the lift track being coupled to the front side, the lift track comprising a pair of track rails, each of the pair of track rails being an H-shape having a pair of slots;

a lift car coupled to the lift track, the lift car having a track engagement portion and a perpendicular platform;

a plurality of sliding retainer clips, the plurality of sliding retainer clips being coupled to the track engagement portion of the lift car, each of the plurality of sliding retainer clips having a pair of arms and a pair of fingers, each of the pair of fingers being perpendicularly coupled to an inside edge of each of the pair of arms, the pair of fingers being slidably engageable within the pair of slots of the pair of track rails;

a seat coupled to the lift car, the seat being coupled to the perpendicular platform, the seat having a pair of pivotable armrests;

a pair of handles coupled to the vertical frame proximal the top end, the pair of handles extending perpendicularly to the rear side;

a lift bracket coupled to the base frame, the lift bracket being coupled to the rear end of the base frame;

a lift mechanism coupled to the lift bracket, the lift mechanism moving the lift car to and from a lowered position and an alternate raised position, the lift mechanism comprising:

a motor coupled to the lift bracket;

an actuator arm coupled to the motor, the actuator arm having a proximal end pivotably coupled to the motor and a distal end having a hinged tip, the hinged tip being coupled to the perpendicular platform of the lift car, the actuator arm having a compacted position when the lift car is in the lowered position and an alternate extended position when the lift car is in the raised position; and a control switch coupled to the vertical frame, the control switch being in operational communication with the motor to move the actuator arm from the compacted position to the alternate extended position;

a battery bracket coupled to the base frame, the battery bracket being coupled to the front end of the base frame;

a battery coupled to the battery bracket, the battery being in operational communication with, and providing power to, the motor; and a charging port coupled to the vertical frame, the charging port being in operational communication with the battery.

14. A wheelchair lift apparatus comprising:

a base frame having a front end, a rear end, a left side, and a right side;

a pair of wheel wells coupled to the base frame, each of the pair of wheel wells having a vertical riser and a horizontal extension, the vertical riser being coupled to the front end of the base frame;

a plurality of wheels coupled to the base frame, the plurality of wheels comprising a pair of rear wheels coupled to the base frame proximal the rear end and a pair of swivelable front wheels coupled to an underside of the horizontal extension of the pair of wheel wells;

a pair of wheel locks coupled to the base frame, the pair of wheel locks being selectively engageable with the pair of rear wheels to prevent the wheelchair lift apparatus from rolling;

a pair of footrests coupled to the pair of wheel wells, the pair of footrests being coupled to a top side of the horizontal extension of the pair of wheel wells, each of the pair of footrests having a raised back and a tapered profile;

a vertical frame coupled to the base frame, the vertical frame having a front side, a rear side, a top end, and a bottom end, the bottom end being perpendicularly coupled to the rear end of the base frame;

a lift track coupled to the vertical frame, the lift track being coupled to the front side, the lift track comprising a pair of track rails, each of the pair of track rails being an H-shape having a pair of slots;

a lift car coupled to the lift track, the lift car having a track engagement portion and a perpendicular platform;

a plurality of sliding retainer clips, the plurality of sliding retainer clips being coupled to the track engagement portion of the lift car, each of the plurality of sliding retainer clips having a pair of arms and a pair of fingers, each of the pair of fingers being perpendicularly coupled to an inside edge of each of the pair of arms, the pair of fingers being slidably engageable within the pair of slots of the pair of track rails;

a seat coupled to the lift car, the seat being coupled to the perpendicular platform, the seat having a pair of pivotable armrests;

a pair of handles coupled to the vertical frame proximal the top end, the pair of handles extending perpendicularly to the rear side;

a lift bracket coupled to the base frame, the lift bracket being coupled to the rear end of the base frame;

a lift mechanism coupled to the lift bracket, the lift mechanism moving the lift car to and from a lowered position and an alternate raised position, the lift mechanism comprising:

a motor coupled to the lift bracket;

an actuator arm coupled to the motor, the actuator arm having a proximal end pivotably coupled to the motor and a distal end having a hinged tip, the hinged tip being coupled to the perpendicular platform of the lift car, the actuator arm having a compacted position when the lift car is in the lowered position and an alternate extended position when the lift car is in the raised position; and a control switch coupled to the vertical frame, the control switch being in operational communication with the motor to move the actuator arm from the compacted position to the alternate extended position;

a battery bracket coupled to the base frame, the battery bracket being coupled to the front end of the base frame;

a battery coupled to the battery bracket, the battery being in operational communication with, and providing power to, the motor; and a charging port coupled to the vertical frame, the charging port being in operational communication with the battery.

* * * * *